United States Patent [19]

Kinser

[11] 4,136,870

[45] Jan. 30, 1979

[54] SCORE KEEPING METHODS

[76] Inventor: Vernon Kinser, Box 157A, Rte. 1, Jenkins, Mo. 65677

[21] Appl. No.: 770,278

[22] Filed: Feb. 18, 1977

[51] Int. Cl.[2] ..... A63D 5/00

[52] U.S. Cl. ..... 273/54 C

[58] Field of Search ..... 273/43 R, 43 A, 49, 273/54 R, 54 C

[56] References Cited

U.S. PATENT DOCUMENTS

| | | | |
|---|---|---|---|
| 2,949,300 | 8/1960 | Huck et al. | 273/43 A |
| 3,170,719 | 2/1965 | Kraus | 273/54 C UX |
| 3,281,855 | 10/1966 | Richman et al. | 273/54 R X |
| 3,466,041 | 9/1969 | Byrd et al. | 273/49 |
| 3,610,619 | 10/1971 | Matcovich et al. | 273/54 C |
| 3,710,080 | 1/1973 | Ellis | 273/54 R UX |

*Primary Examiner*—Anton O. Oechsle
*Attorney, Agent, or Firm*—Ralph W. Kalish

[57] ABSTRACT

A score keeping method for the game of bowling including a score keeping sheet for use by one of the players, an open switch for control of the pin setting machine by the other player, and a counter mounted on the ball return chute to count each time a bowling ball is returned to the players.

2 Claims, 2 Drawing Figures

SCORE KEEPING METHODS

This invention relates generally to a new score keeping method.

More specifically my invention relates to score keeping for games like horseshoe pitching and bowling, which in their present respective forms, are played by pitching horseshoes at a stake as a target some distance from the players, or, by rolling a bowling ball down an alley and at some distance to strike pins as a target.

Presently I refer, still more specifically and fully, to the game of bowling which is played on a modern bowling alley by rolling a bowling ball at an array of pins the object being to score by knocking down as many pins as possible. The pins are then automatically put back in place or reset by a pin setting machine which, also returns the bowling ball to the players by way of a ball return chute.

Whether the game being played is bowling or horseshoe pitching the score keeping problem is the same. To allow each player to keep his own score with no restrictions would invite dishonesty. So usually the score keeping is accomplished manually by a non-player score keeper who keeps score on a score keeping sheet as the scores are announced by the players, but the score keeper could make a mistake or be dishonest.

My present invention has, hence, for its prime object the provision of a score keeping method for use by the players, that requires in combination, enough cooperation between the players and enough ways to check back in case of controversy, so that the players can keep score to the satisfaction of everyone.

And with the above and other objects in view, my invention resides in the novel features of form, construction, arrangement, and combination of parts, presently described and pointed out in the claims.

In the accompanying drawings (one sheet)

Figure 1:
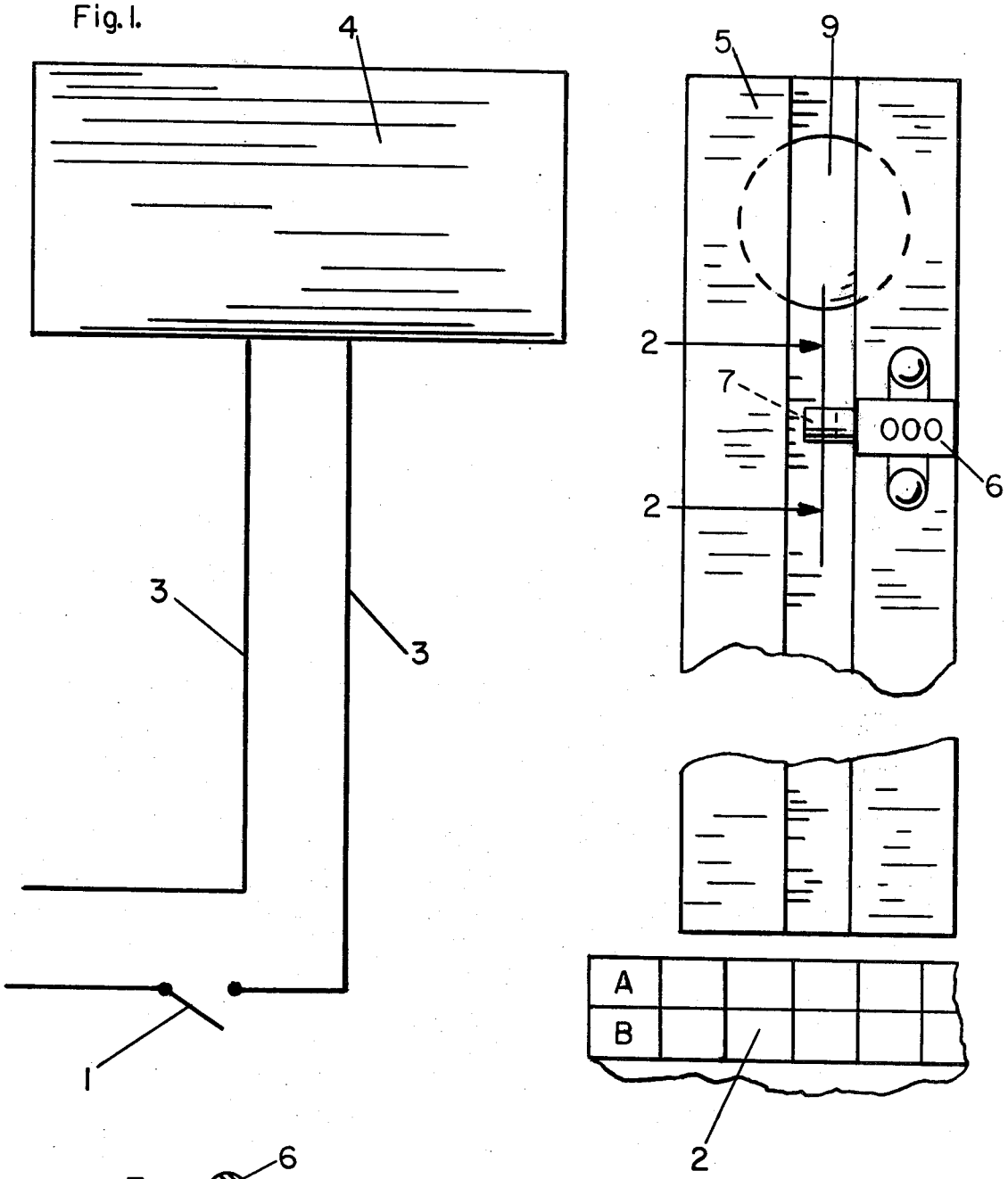
FIG. 1 is an elevated view of a modern bowling alley.
Figure 2:
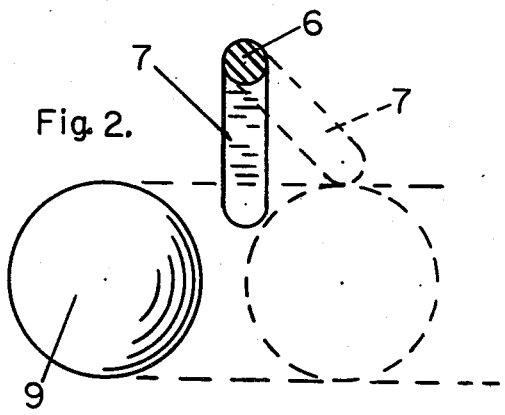
FIG. 2 is a view along line 2—2 FIG. 1.

Referring now more in detail and by reference characters to the drawings, which illustrate a particular version of my invention that is highly adapted to be used in the game of bowling, I designate the open switch 1 and the score keeping sheet 2(fragment shown) for exclusive respective use by the players A and B, the usual number of players in the game of bowling.

Player A must be completely satisfied with any score recorded by player B on the score keeping sheet 2 and willing to cooperate by closing the switch 1, because it is wired for control of the pin setting machine 4 by means of the wire 3, into the same ciruit thereas. So player A, if he desires, in effect, can stop the game of bowling thereby keeping the score intact.

For example, suppose that player A has scored by rolling the bowling ball 9 and, now, is not satisfied with the score entered on the score keeping sheet 2 by player B. Player A can now register the fact that he is not satisfied, by failing to close the switch 1.

But, unless some way is provided to locate the exact position on score keeping sheet 2 where the score of player A should be recorded, it would be useless to attempt to correct the score keeping sheet 2 because there could still be controversy as to whether or not the score has already been recorded.

So therefore, a way is provided, for which purpose, a counter 6 is mounted on the ball return chute 5, being both equipped with and responsive to the lever 7, and disposed with respect to the ball return chute 5 so that the lever 7 must be actuated each time the bowling ball 9 is returned to players A and B by way of ball return chute 5, for purposes now appearing.

An arbitrator, thus, called on to the scene by player A, can quickly resolve any controversy concerning the score recorded on score keeping sheet 2. With the correct score intact, as has been explained, and on hand, the arbitrator needs only to locate the exact position on score keeping sheet 2 where the score of player A should be recorded by comparing the number registered on counter 6 with the number of times a score has been recorded on score keeping sheet 2.

Unless player A becomes dissatisfied with the score keeping, though, the game of bowling can proceed smoothly. Again for example, player B, in his turn, rolls the bowling ball 9 to make a score and records the score on score keeping sheet 2, player A closes the switch 1, and the pin setting machine 4 then makes ready for the bowling ball 9 to be rolled again by resetting the pins (not shown) and returning the bowling ball 9 to the players A and B by the way of the ball return chute 5.

It will be understood that, if desired, various changes and modifications in the form, construction, arrangement and combination of parts of my score keeping method may be made and substituted for those herein shown and described without departing from the nature and principles of my invention.

Having thus described my invention, what I claim and desire to secure by letters patent is;

1. A method for promoting accuracy in score keeping in the game of bowling wherein there is utilized a bowling alley, a bowling pin-setting machine, a remote controller for said pin-setting machine, a bowling ball return chute, a counting mechanism provided in said chute for progressively indicating the balls returned whereby the total number of rolls may be immediately ascertained, and a score keeping sheet having discrete, delineated portions for receiving the score of each ball, said method comprising ascertaining the number of pins remaining after opponent player's play, placing such opponent player's score for such play within the portion of said score keeping sheet corresponding to the particular turn, then operating said controller to effect resetting of the pins for the next player's play, and comparing the number indicated on the counting mechanism with the number of rolls determinable by reference to the score sheet to establish the correct portion of said sheet for the succeeding score reception.

2. The method as defined in claim 1 and further characterized by said remote controller for said pin-setting mechanism having a normally open switch located conveniently with respect to the site of the score keeping sheet so that a player,upon becoming satisfied that his opponent's score has been accurately recorded on said sheet, may effect operation of said controller for pin setting.

* * * * *